US008123041B2

(12) United States Patent
Vladimir

(10) Patent No.: US 8,123,041 B2
(45) Date of Patent: Feb. 28, 2012

(54) METHOD AND DEVICE FOR SEPARATION OF A LOOSE MIXTURE IN A FLUID MEDIUM

(75) Inventor: Suxin Vladimir, Paramus, NJ (US)

(73) Assignee: Airomachus, Co., Paramus, NJ (US)

( * ) Notice: Subject to any disclaimer, the term of this patent is extended or adjusted under 35 U.S.C. 154(b) by 241 days.

(21) Appl. No.: 12/666,797

(22) PCT Filed: Nov. 28, 2008

(86) PCT No.: PCT/UA2008/000070
§ 371 (c)(1),
(2), (4) Date: Dec. 25, 2009

(87) PCT Pub. No.: WO2010/056220
PCT Pub. Date: May 20, 2010

(65) Prior Publication Data

US 2011/0204002 A1 Aug. 25, 2011

(30) Foreign Application Priority Data

Nov. 12, 2008 (UA) ..... 200813154

(51) Int. Cl.
*B03B 5/62* (2006.01)
*B07B 4/02* (2006.01)

(52) U.S. Cl. ..... 209/157; 209/137; 209/644; 209/932

(58) Field of Classification Search ..... 209/44.2, 209/639, 644, 911, 920, 932, 933, 34, 35, 209/136, 137, 157; 210/513, 800, 801
See application file for complete search history.

(56) References Cited

U.S. PATENT DOCUMENTS

| | | | | | |
|---|---|---|---|---|---|
| 172,506 | A * | 1/1876 | Seck | 209/137 |
| 194,320 | A * | 8/1877 | Alberty | 209/137 |
| 1,348,043 | A * | 7/1920 | Parkinson | 209/135 |
| 1,530,277 | A * | 3/1925 | Mettler, Sr. | 209/137 |
| 2,828,011 | A * | 3/1958 | Whitby | 209/20 |
| 4,490,247 | A * | 12/1984 | Forsberg et al. | 209/20 |
| 5,427,248 | A * | 6/1995 | Levy et al. | 209/137 |
| 6,845,867 | B2 * | 1/2005 | Sussegger et al. | 209/151 |
| 6,958,121 | B2 * | 10/2005 | Leskow | 210/623 |
| 7,422,114 | B2 * | 9/2008 | Guptail | 209/44.2 |

* cited by examiner

*Primary Examiner* — Joseph C Rodriguez
(74) *Attorney, Agent, or Firm* — Michael J. Feigin, Esq.

(57) ABSTRACT

Method of separation of loose mixture in fluid medium consists in the gravity feed of particles, aerodynamic monotonically increasing effect on them at acute angle to the vertical line by the cascade of slot jets and the outlet of separated fractions into separate collectors. Before aerodynamic effect on loose mixture particles each jet is transferred to developed turbulence mode by their vertical expansion jets until jets are merged with each other with faulty or close to it form of jet formation and the appearance of at least two circulation zones different in size in each inter-jet space of all contiguous jets. The device for separation contains the bunker with vibrating chute mounted underneath the jet generator, the flat nozzles located one under another at acute angle to the vertical line, the height of cross sections of which, step and angle of installation increase top-down. The generator is connected with the source of air supply under pressure, and is covered by the side walls, and grade collectors. Each nozzle is equipped with rectangular rigid wall adjoined to its top across full width of the nozzle. The size of the rigid wall width makes at least three dimensions of cross-sectional height of the nozzle contiguity, and the ratio of installation step of nozzles to the height of cross section of the upper nozzle in relation to it is not less than four.

13 Claims, 1 Drawing Sheet

METHOD AND DEVICE FOR SEPARATION OF A LOOSE MIXTURE IN A FLUID MEDIUM

FIELD OF THE DISCLOSED TECHNOLOGY

The invention relates to methods and devices for air or liquid separation of loose materials and can be used in food, chemical and other branches of industry, where the separation of mixtures into factions is required, as well as in agriculture to prepare seeds for sowing and for breeding purposes.

BACKGROUND

The method of separation of loose mixture in fluid medium consists in the gravity feed of particles of the material being separated at regular speed, the impact on them with uniform air flow resulted in the output of finished fractions [see Patent of the USSR #1176976 Cl. B 07 B 4/02 issued in the Bulletin #33 on Sep. 7, 1985].

The device for loose material separation contains a fan inlet, feeding bunker located above, and collectors of finished grades with the unit for light particles dropout [see Patent of the USSR #1763051 Cl. B 07 B 4/02 issued in the Bulletin #35 on Sep. 23, 1992].

The effect of air flow to single loose mixture particle is carried out once and only on the random basis in the method and device indicated. Therefore, the quality (accuracy) of the separation is quite low with a rough separation of the mixture into grades. For this reason, such methods and devices are primarily used for pre-treatment of loose mixture from light impurities.

The method of separation of loose mixture in fluid medium consists in the gravity feed of particles, aerodynamic monotonically increasing effect on them at acute angle to the vertical line with the cascade of slot jets resulted in the output of finished grades. This effect is carried out in free alternating power scanning mode with increasing amplitude and scanning angle. The device for separation contains the bunker with vibrating chute, the jet generator installed below, with flat nozzles located one under another at acute angle with the vertical line, the height of cross sections of which, step and installation angle increase top-down. The generator is connected with the source of air supply under pressure and is covered by the side walls. The device has grade collectors located under nozzles [see Patent of Ukraine #45881 Cl. B 07 B 4/02 issued in the Bulletin #4 on Apr. 15, 2002].

Particle separation occurs this way due to the difference ratio of their weight and air resistance force. Due to special mode of air jets effecting loose mixture, this method is more accurate and more stable in time, especially at separating irregular shaped particles. This was possible because the effect with the cascade of jet flow in scanning mode enables to approach each loose mixture particle multiply and in different directions.

But the method and the device have the following drawbacks.

Free alternating jet cascade mode inevitably leads to periodic, unstable in time and space pressure zone origination and discharge with the occurrence of direct and reverse flows. Particles (especially light) are involved in a direction opposite the movement of the main flow, which causes partial mixing with the material already separated. The instability in time of this phenomenon will eventually lead to jet cascade breaking in any random place, which further strengthens the reverse flow in this zone and, consequently, intensifies the process of mixing.

In addition, air jet interruption contributes to the generation breakdown (oscillatory motion cessation) that significantly reduces the quality of separation, bringing it to the quality of separation by usual winnowing machine.

The closest by their essence and the effect achieved are the method and device used to separate loose mixture in fluid medium having been taken for a prototype model, the essence of which is as follows:

The method of separation of loose mixture in fluid medium consists in the gravity feed of particles, aerodynamic monotonically increasing effect on them at acute angle to the vertical line with the cascade of slot jets resulted in the output of finished grades, with the aerodynamic effect carried out in the mode of resonance self-oscillatory motion of each jet and the whole jet cascade on the frequency of fundamental harmonic of fluctuations.

The device for separation of loose mixture in fluid medium contains the bunker with vibrating chute, the jet generator installed below, with flat nozzles located one under another at acute angle with the vertical line, the height of cross sections of which, step and installation angle increase top-down. The generator is connected with the source of air supply under pressure and is covered by the side walls and grade collectors. In this case each pair of contiguous nozzles is equipped with a resonance chamber connected with its inter-nozzle space. Besides, chambers have units equipped for their volume adjustment, where the ratio of the height of the cross section of nozzles to the step of their installation is in the range of 0.2-0.25, and the ratio of the extreme upper and the extreme lower angles of the nozzles installation makes 0.65-0.75 [see Patent of Ukraine #60254 Cl. B 07 B 4/02, A 01 F issued in the Bulletin #7 on Jul. 15, 2005].

Undoubtedly, flat jet cascade application in separation process provides high quality separation of loose mixture into grades, but only if slot jet cascade is in the mode of self-oscillatory motion on the frequency of fundamental harmonic. But self-oscillatory mode requires the device to be equipped with the resonance chambers making the device complicated. In addition, to provide precise resonance frequency, resonance chambers are equipped with their volume adjusting units, and to exclude the possibility of self-oscillatory motion on higher harmonic frequencies, it is required to keep accurately to the step and installation angles of the nozzles. Consequently, despite the fact that the described method of separation of loose mixture in the fluid medium provides the necessary quality of the separation of loose mixture into grades, but its implementation requires a substantial complication of the device and its maintenance difficulties, in particular, the volume adjustment in resonance chambers, which is related to disadvantages. To simplify the same device without rejecting the application of slot jet cascade, cascade formation principle should be changed.

The basis for the invention is creating the method and device for separation of loose mixture in fluid medium providing quality improvement of loose mixture being separated via greater turbulence achievement and device maintenance simplification by forming self-adjusting system by means of optimizing the aerodynamic effect on the particles of initial source material by transferring each jet flow into developed turbulence mode, which totally excludes partial mixing of finally separated material and enhances the quality of separation at multifunctional division of irregularly shaped particles.

SUMMARY OF THE DISCLOSED TECHNOLOGY

The task is solved so that the developed method for separation of loose mixture in fluid medium comprises the gravity feed of particles, aerodynamic monotonically increasing effect on them at acute angle to the vertical line by the cascade of slot jets and the output of separated grades to special collectors, and according to the suggestion, before aerodynamic influencing loose particles in the mixture each jet is transferred to developed turbulence mode by increasing their vertical jets prior to merging jets with each other with faulty or close to it form of jet formation and appearing of at least two circulation zones different by size in each inter-jet space of all contiguous jets.

The solution of the problem is also that the device for the suggested method contains the bunker with vibrating chute for gravity feed mixture in the separation zone. The jet generator installed underneath it together with flat nozzles located one under another at acute angle with the vertical line, the height of cross sections of which, step and installation angle increase top-down. The generator is connected with the source of air supply under pressure and is covered by the side walls, and grade collectors. In accordance with the suggestion each nozzle is equipped with rectangular rigid wall adjusted to its top of the full nozzle width.

The width of the rigid wall makes at least three dimensions of cross-sectional height of the nozzle contiguity, and the ratio of installation step of nozzles to the height of cross section of the upper nozzle with respect to it is not less than four.

A distinctive feature of the proposed method of separation of loose mixture in fluid medium is the application of the effect of bilateral jet expansion in the flat nozzle, at which the bending of the axis of the jet reaches a maximum with great degree of expansion, and does not change with increasing degree of expansion (faulty jet flow form). This allows the ratio of values (sizes) to maintain constant circulation zones, i.e. the number of Reynolds does not affect the size of circulation zones. Therefore, there is no need for any speed adjustment for air jet efflux.

Technical result of the invention is the possibility to simplify significantly the device for separation by a new approach to the cascade of slot jets and eliminate several units and components from its construction through creation of stable circulation zones in self-adjusting system. Meanwhile, the quality of separation of loose material at its multigrade division by size, shape, or specific weight of particles is not reducing but rather increasing.

Consequently, the change in flat jet cascade formation, i.e. in the method of separation, automatically entails a substantial simplification of the device without deterioration of its technical and operational specifications, that is, keeping the quality of multigrade separation of loose mixture, e.g. grain crops, both with simple and complex form of grains, which is important in agriculture at seeds preparation for sowing and for breeding purposes.

Thus, all essential features of the suggested technical solution provide attaining the objectives of the invention.

Positive aspects of the present invention having been stated will be evident to professionals in this field of knowledge after reading by them the below description of the preferred variant of the proposed invention implementation with illustrative material attached.

BRIEF DESCRIPTION OF THE FIGURES

FIG. 2—cross-section of A-A in FIG. 1 (nozzle cross-section).

DETAILED DESCRIPTION OF EMBODIMENTS OF THE DISCLOSED TECHNOLOGY

Figure 1:
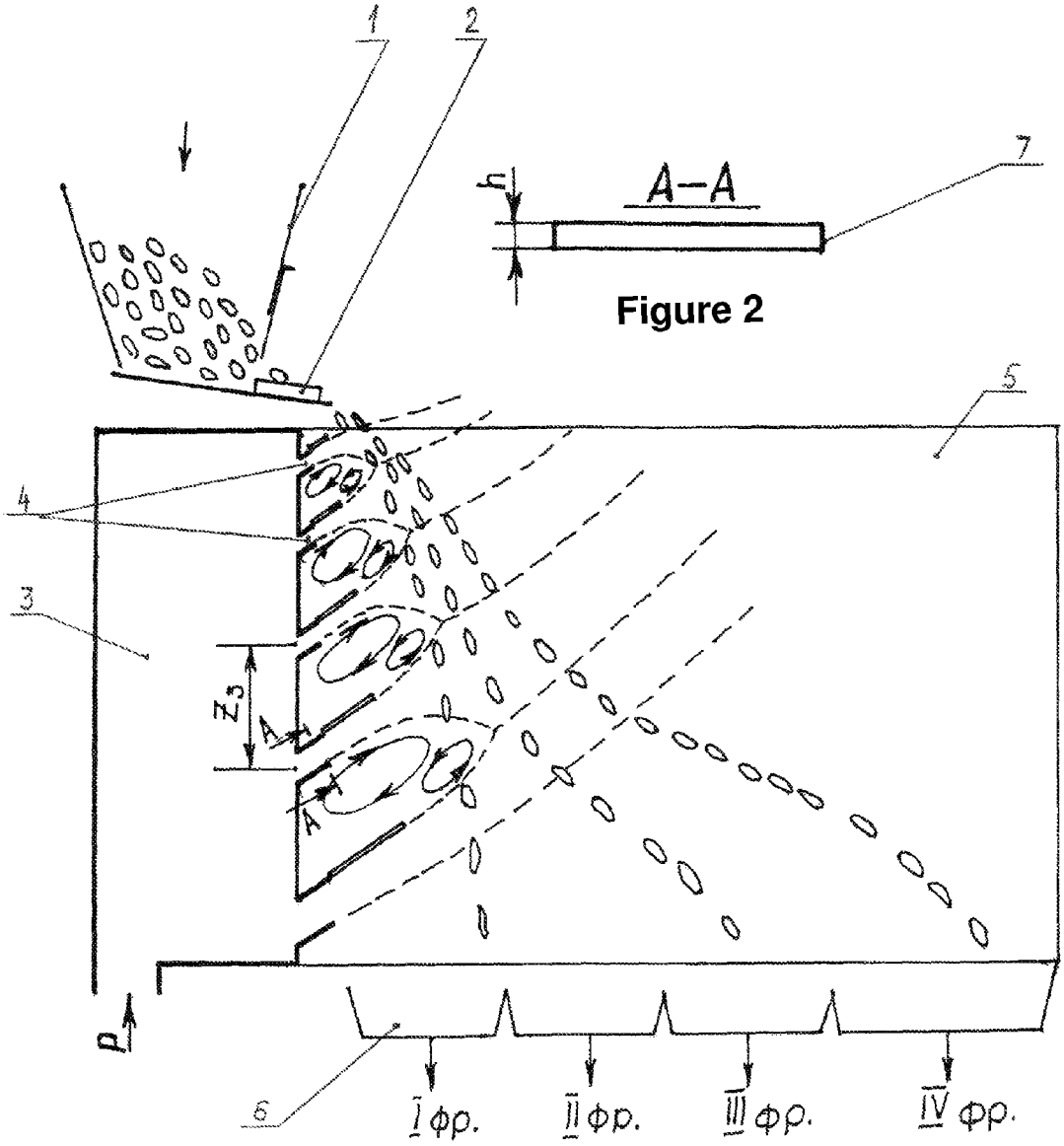
FIG. 1—schematic diagram for the claimed method.

Technical advantages: construction simplification of the device for loose mixture separation with simultaneous quality improvement for mixtures being separated into separate grades by achievement of greater jet flow turbulence, which resulted in self-adjusting system occurrence due to device operation in faulty mode of flat jet formation.

Application: for air or liquid separation of loose materials in food, chemical and other branches of industry, at separating mixtures in grades, as well as in agriculture to prepare the seeds for sowing and for breeding purposes.

The device for the method of separation of loose mixture in fluid medium contains the bunker 1 with vibrating chute 2 for the gravity feed of particles in separation zone. Jet generator 3 being developed as the closed space system on one side is installed under vibrating chute 2 with a number of flat nozzles 4. The number of the latter depends on the necessary device capacity, but should not be less than three. The height of cross section of nozzle h, the angle $\alpha$ of their installation fitted to the vertical line and step Z between the nozzles increase top-down. Each nozzle 4 is equipped with a rigid wall 5 adjusted to its top at its full width. However, as mentioned above, the size of the width of the rigid wall 5 is not less than three dimensions of cross-sectional height of the contiguity nozzle 4, and the ratio of step installation 4 to the cross-sectional height of the nozzle which is upper in relation to the nozzle 4 is not less than four.

Grade collectors 6 for the material separated are adjoined to the generator 3 from below.

The side edges of nozzles 4 and inter-nozzle space are covered by the side walls 7 to exclude air inflow from the atmosphere, which will inevitably lead to generation breakdown. The generator 3 is connected with the source of air supply under pressure P, for example, high-pressure fan (not shown due to its well-known model).

The method is carried out in the following way.

First, the gravity feed of loose material particles is carried out. Vibrating chute 2 is used for this, from which the particles fall in the separation zone. Particles being in free fall state are affected by flat jet cascade at acute angle to the vertical line in developed turbulence mode of the generator 3 (shown with dotted line), which occurs due to bending of jets during their expansion in nozzles, and the presence of a rigid wall 5 of specific size provides the formation of circulation zones different in size. To ensure general stream stability, the upper circulation zone should be larger in size than the lower one.

After particles pass jet cascade the output of ready grades is carried out into collectors 6. Simultaneously with the process of separated particles collecting the selection of intermediate grades is carried out, returning particles to the bunker 1 for re-separation.

The device works as follows.

Loose mixture passes through the flat jet cascade due to gravity force from the bunker 1 through vibrating chute 2 (indicated with dotted line) that flows out of the nozzle 4 to the separation unit made in a form of grade collectors 6.

Synchronous operation of nozzles 4 is provided by the correct ratio of main geometric parameters of the generator 3, their sizes, angles and places of installation in the device. After separation in jet cascade, the particles fall into grade collectors 6.

Tests of a prototype device for the separation of loose mixture, in particular, the grains of grain crops, have shown that the proposed method provides high-quality separation of grains into several grades.

The technical advantages of the proposed technical solutions, as compared with the prototype, can be considered the simplification of the device for separation of loose mixture, with simultaneous quality improvement of the separation of mixtures into separate fractions by the achievement of greater jet flow turbulence, which results in formation of self-adjusting system owing to device operating in faulty mode of flat jet efflux.

After describing the suggested method and device for separation of loose mixture in fluid medium, it is should be evident for the specialists in this branch of knowledge, that all information stated above is merely illustrative and not restrictive, as represented by this particular example. Many possible modifications of the device components, in particular, the number of nozzles and their size, the size of the generator, grade collectors structure, vibrating chute structure, feeding bunker, the source of high pressure air supply unit may vary depending on the source loose material type, and it is understood that all indicated above is within the volume of conventional and natural approaches in this field of knowledge and such is considered as being within the volume of the proposed technical solutions.

The quintessence of the proposed technical solution is that the separation is performed with air jet cascade in developed turbulence mode resulting from jet expansion in the vertical line, and agglutination at faulty or close to it flow form, and the formation of not less than two circulation zones different by sizes in the beginning of each inter-jet space of all contiguous jets that allow to create self-adjusting system and improve significantly the quality of loose mixture separation into grades. These circumstances have empowered the suggested method and device with stated above and other advantages. Changing the forming principle of jet cascade and their treatment mode for another, of course, will limit the benefits listed above, and will lead to complication of the device construction, and therefore shall not be considered as new technical solution in this field of knowledge. As other solutions like the method highlighted do not require any engineering or designing creativity, and therefore, may not be the result of creative activities or new intellectual property, being the subject to the protection by enforcement documents.

A method of separation of loose (friable) substances in a liquid medium functions with a gravitational supply of particles, the aero-dynamical, gradually increasing impact upon these of a cascade of flat air jets at a acute angle to the vertical surface, and the diversion of the dislodged fractions into separate collectors, distinguished by the fact that, prior to the aero-dynamical impact upon the particles of the loose (friable) substance, the flow of each air jet is shifted into a regime of acute turbulence by expanding them vertically until the jets merge with one another in a joining or near-joining shape of jet flow, and the placing into each inter-jet space of all adjoining jets differing from each other in size by at least two circle areas. A joining jet flow is defined as a jet flow created from two or more individual jet flows.

Equipment for the implementation of the above method of separating loose (friable) substances in a liquid medium, which includes a bunker with a vibration tray for the gravitational supply of substance to the separation area, a jet generator inserted underneath, with flat controls mounted one underneath the other at a acute angle to vertical surface, with the height of their cross section, the space and angle of the mounting, expanding from top to bottom, and which is connected to the source of the air flow under pressure and enclosed in side walls; and collectors of fractions, characterized by each control being equipped with a hard rectangular wall, adjacent to it at the top along the entire width of the control.

The equipment may be characterized by the fact that the width of the hard wall is at least three times larger than the height of the cross section of the adjacent control, and the space between the controls is at least four times greater than the height of the cross section.

The invention claimed is:

1. A method of separating substances in a liquid medium comprising the steps of:

operating a plurality of air jets positioned at acute angles to a vertical surface, wherein each air jet of said plurality differs in size;

gravitationally dropping a stream of said substances past said plurality of air jets, diverting by way of operation of said plurality of air jets dislodged fractions of said substances into separate collectors, and creating a circular air path between at least two air jets of said plurality of air jets.

2. The method of claim 1, wherein said air jets are cascaded.

3. The method of claim 2, wherein said air jets comprise flat nozzles.

4. The method of claim 1, wherein said substances are friable.

5. The method of claim 1, wherein two successive flows of air from two successive air jets extend vertically, forming a joining jet flow.

6. The method of claim 5, wherein every two successive air jets form a joining jet flow.

7. The method of claim 6, wherein an acute turbulent region of jet flow is formed between every two successive air jets.

8. A device for separation of friable substances in a liquid medium comprising:

a bunker further comprising a vibration tray and outlet designed for gravitationally induced expelling of said friable substances into a separation area;

a jet generator beneath said bunker;

a plurality of flat-nozzled jets extending, at differing lengths from, and operatively connected to said jet generator at acute angles to a vertical surface of said jet generator; and collectors of displaced fractions of said friable substances extending an entire width of a control area.

9. The device of claim 8, wherein a length of each successive said jet increases relative to the length of a said jet above.

10. The device of claim 8 further comprising side walls.

11. The device of claim 8, wherein each said collector is equipped with a hard rectangular wall.

12. The device of claim 11, wherein a width of said hard rectangular wall is at least three times larger than a height of a said collector comprising said hard rectangular wall.

13. The device of claim 12, wherein a space between each said jet is at least four times greater than a height of said collectors.

* * * * *